United States Patent [19]

Mix et al.

[11] Patent Number: 4,820,938

[45] Date of Patent: Apr. 11, 1989

[54] LOW VOLTAGE MOTION SENSOR FOR ACTIVATING A HIGH VOLTAGE LOAD

[75] Inventors: Jerome M. Mix, Redwood City; Charles C. Hu, San Jose, both of Calif.

[73] Assignee: The Watt Watcher, Inc., Santa Clara, Calif.

[21] Appl. No.: 202,179

[22] Filed: Jun. 3, 1988

[51] Int. Cl.[4] ..... G08B 13/16

[52] U.S. Cl. ..... 307/117; 307/116; 307/140; 361/179; 340/552; 340/554

[58] Field of Search ..... 307/117, 116, 140, 141.4; 361/179, 168.1, 169.1; 340/552, 554; 323/902

[56] References Cited

U.S. PATENT DOCUMENTS 4,166,273 8/1979 Riley, Jr. et al. ..... 340/552 X 4,661,720 4/1987 Cameron, Jr. et al. ..... 340/554 X 4,719,405 1/1988 Boucher ..... 323/902 X

*Primary Examiner*—William M. Shoop, Jr.

*Assistant Examiner*—Sharon D. Logan

*Attorney, Agent, or Firm*—Townsend and Townsend

[57] ABSTRACT

The present invention utilizes a latching relay having on and off inputs for controlling power to a load. The on and off inputs of the relay are controlled by pulse generators which are in turn controlled by an occupancy sensor circuit. These pulse generators provide pulses when movement is initially detected in a room and when no movement has been detected for a predetermined time, respectively. The outputs of the pulse generators are coupled to an isolation circuit which isolates the power supply for the occupancy sensor from the pulses during each pulse to prevent damage to the power supply.

12 Claims, 3 Drawing Sheets

LOW VOLTAGE MOTION SENSOR FOR ACTIVATING A HIGH VOLTAGE LOAD

BACKGROUND

The present invention relates to motion sensors which detect motion in a room and activate a load, such as lights, coupled to line power.

Motion sensors or occupancy sensors control lights and other electric loads by detecting doppler shifts in transmitted ultrasonic sound. An occupancy sensor would typically transmit ultrasonic sound waves via one or more transmitters which then reflect off of objects in the room and are detected by one or more receivers. A doppler shift of the reflected signals indicates the presence of movement within the room, and can be detected by noting frequency changes from the transmitted frequency. In the absence of a detected doppler shift, an electric load can be switched off, thereby conserving energy when no people are in the room. An example of such a system is shown in U.S. Pat. No. 4,661,720, hereby incorporated herein by reference.

It is desirable to have such an occupancy sensor be able to operate on low voltages to reduce power consumption and yet be able to switch the high voltages of the AC line coupled to a load such as room lights, etc.

SUMMARY OF THE INVENTION

The present invention utilizes a latching relay having on and off inputs for controlling power to a load. The on and off inputs of the relay are controlled by pulse generators which are in turn controlled by an occupancy sensor circuit. These pulse generators provide pulses when movement is initially detected in a room and when no movement has been detected for a predetermined time, respectively. The outputs of the pulse generators are coupled to an isolation circuit which isolates the power supply for the occupancy sensor from the pulses during each pulse to prevent damage to the power supply.

In the preferred embodiment, a transformer steps down the line voltage and provides it to a rectifier. The rectifier provides a rectified signal to one end of a pair of control coils in the latching relay. The other end of the control coils are the on and off lines which are coupled to the two pulse generators. The on and off lines are also coupled together through a pair of diodes to the power supply for the occupancy sensor.

A power isolation circuit is connected between the on and off lines and the power regulator to isolate the power regulator during the pulses. A capacitor coupled to the power regulator provides power during this time. The power isolation circuit is preferably a transistor with its control electrode being controlled by the pulse generators through a pair of transistors.

The pulse generators are preferably a pair of one shots which are responsive to different states of an activating signal from the motion control sensor. The outputs of the one shots are coupled to the power isolation circuit and to Darlington pair transistor drivers whose outputs are coupled to the on and off lines, respectively.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
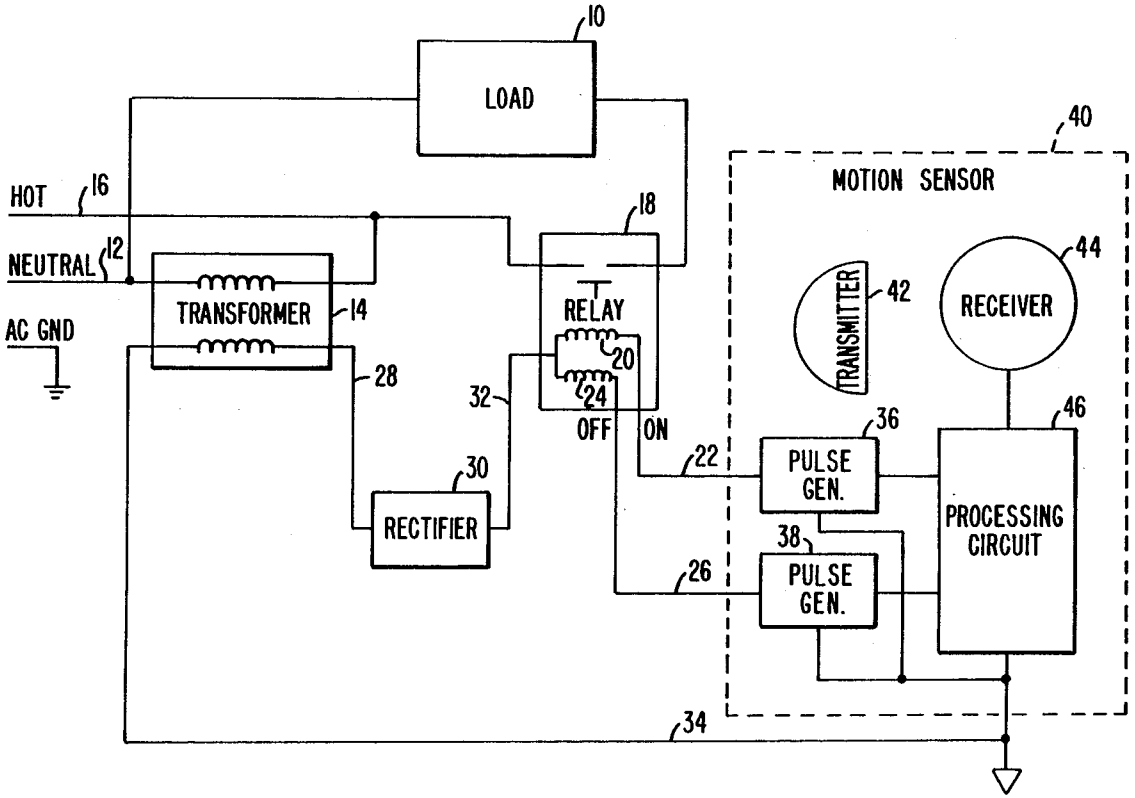
FIG. 1 is a block diagram of the load control switching system of the present invention.

FIG. 1 shows a switching system for a load according to the present invention. A load 10 is coupled to an input neutral line 12 from the AC power line. The other side of load 10 is coupled to a hot line 16 of the AC power supply through a switch connection of a relay 18.

Relay 18 is a latching relay which is activated into the ON position by a first coil 20 coupled to an ON line 22. A second coil 24 activated by an OFF line 26 switches the relay off. Power is provided to one end of coils 20 and 24 through the secondary winding of transformer 14 which is coupled on a line 28 to a rectifier 30. The rectified voltage is applied on a line 32 to the two coils of relay 18. The circuit is completed by lines 22 or 26 being coupled to ground line 34 through pulse generators 36 or 38 in motion sensor 40.

Motion sensor 40 includes a transmitter 42 which transmits ultrasonic waves. A receiver 44 receives the ultrasonic waves and a processing circuit 46 determines whether or not a doppler shift has occurred and provides an enabling signal to either pulse generator 36 or pulse generator 38, depending upon whether or not motion has been sensed.

Figure 2:
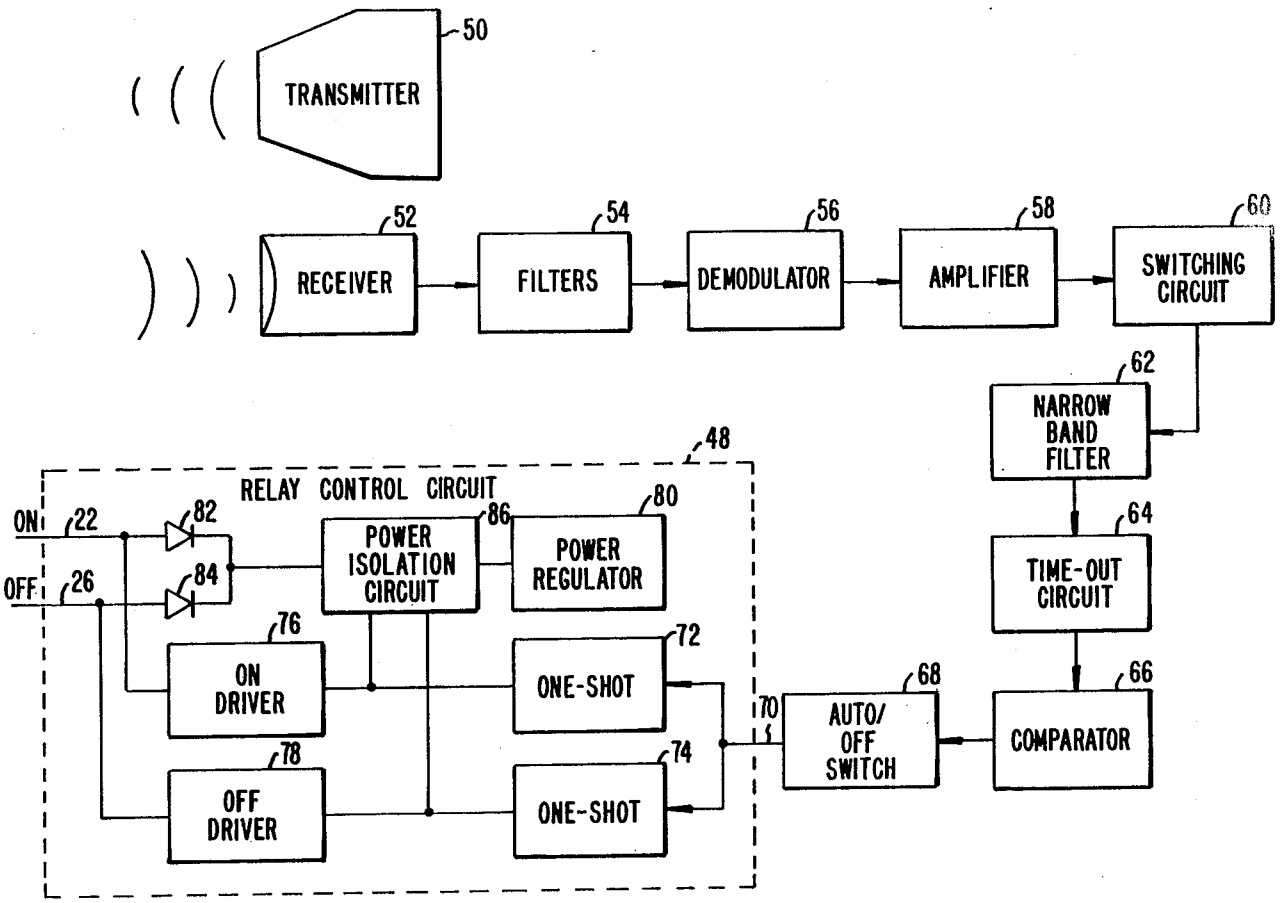
FIG. 2 is a block diagram of the motion sensor of FIG. 1.

Motion sensor 40 is shown in more detail in FIG. 2. A relay control circuit 48 contains the portion of the motion sensor contributing to the present invention. The remainder of the motion sensor is described in one possible embodiment in U.S. Pat. No. 4,661,720, previously incorporated herein.

The motion sensor includes a transmitter 50 which sends out ultrasonic waves and a receiver 52 which detects the reflected waves. The receiver input is passed through filters 54, a demodulator 56, an amplifier 58, a switching circuit 60, a narrow band filter 62, a time-out circuit 64, a comparator 66 and an auto/off switch 68. The operation and purpose of each of these blocks is described in detail in U.S. Pat. No. 4,661,720. Briefly, this circuitry determines whether a doppler shift has occurred and provides a high signal on line 70 if motion is detected in the room to turn on the lights or other load. A low signal is provided on line 70 when there has been an absence of motion for a predetermined, adjustable period of time.

The signal from line 70 is provided to a pair of one shots 72 and 74. One shot 72 is activated by the high signal, while one shot 74 is activated by the low signal. These one shots are provided to ON and OFF drivers 76 and 78, respectively, which are coupled to ON and OFF lines 22 and 26 to activate relay 18 of FIG. 1.

A power regulator 80 provides DC power to the circuitry of the motion sensor from the AC signal received through ON and OFF lines 22 and 26. These lines are coupled together through diodes 82 and 84 and through a power isolation circuit 86 to an input of power regulator 80. The pulse outputs of one shots 72 and 74 control power isolation circuit 86 to interrupt the AC input signal to power regulator 80 during the pulses. This will isolate power regulator 80 from the high voltage pulses generated by the ON and OFF drivers.

Figure 3:
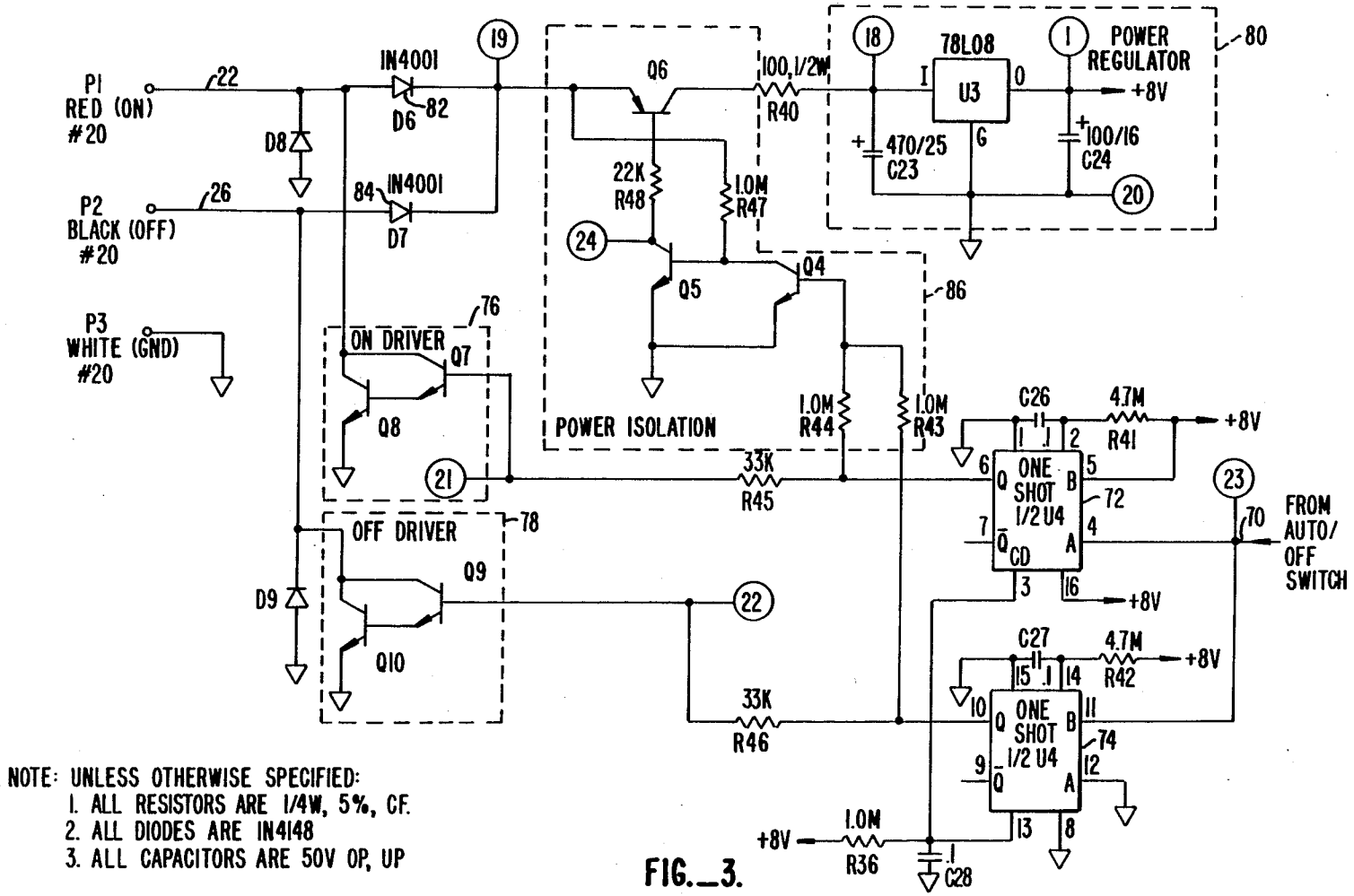
FIG. 3 is a schematic diagram of the relay control circuit of FIG. 2.

FIG. 3 is a schematic diagram of relay control circuit 48 of FIG. 2. As can be seen, 0N driver 76 consists of a Darlington pair of transistors Q7 and Q8, while OFF driver 78 consists of a Darlington pair of transistors Q9 and QlO.

When either of the ON or OFF drivers are turned on by a pulse from one of one shots 72 and 74, this high pulse is also applied through resistor R44 or resistor R43 to the base of transistor Q4 in power isolation circuit 86. When transistor Q4 is turned on, it will divert current from the base of transistor Q5, turning transistor Q5 off. This will remove the current from the base of transistor Q6, turning it off and thereby isolating power regulator 80 from the AC power on lines 22 and 26. A capacitor C23 in power regulator 80 provides the voltage and current needed to obtain the 8 volt output of the power regulator while it is isolated.

The two driver circuits will provide a path to ground for current through either the ON or OFF lines, with diodes 82 and 84 preventing the current from flowing through to the other line. Diodes D8 and D9 protect against any negative voltages that may occur.

Relay 18 of FIG. 1 in one embodiment is activated by a pulse of from 50–250 milliseconds having an amplitude of from 12–24 volts. The one shots of FIG. 3 are adjusted to give an approximately 75 millisecond 8 volt pulse, which provides the same duration pulse at a higher voltage at the output of the ON and OFF drivers.

The present invention thus provides a low voltage circuit which, through ON and OFF drivers 76 and 78, can power the relay to activate the load while at the same time isolating the power regulator for the low voltage circuit.

As will be understood by those familiar with the art, the present invention may be embodied in other specific forms without departing from the spirit or essential characteristics thereof. For example, the 0N and OFF drivers could have a different transistor arrangement, as could power isolation circuit 86. In addition, other types of motion sensors could be used, such as infrared. Accordingly, the disclosure of the preferred embodiment of the invention is intended to be illustrative, but not limiting, of the scope of the invention which is set forth in the following claims.

We claim:

1. In a motion sensor for detecting the presence or absence of motion and providing an activating signal, an improvement for providing ON and OFF signals on ON and OFF lines to a relay controlling power to a load, comprising:

a first pulse generator, having an input coupled to receive said activating signal and an output coupled to said ON line, for producing a pulse output to said ON line responsive to a first state of said activating signal;

a second pulse generator, having an input coupled to receive said activating signal and an output coupled to said OFF line, for producing a pulse on said OFF line responsive to a second state of said activating signal; and means, coupled to said outputs of said first and second pulse generators for isolating a power supply for said motion sensor from said ON and OFF lines during said pulses.

2. The motion sensor of claim 1 further comprising an ON driver coupled between said first pulse generator and said ON line for providing increased current to said ON line, and an OFF driver coupled between said second pulse generator and said OFF line for producing an increased current to said OFF line.

3. The motion sensor of claim 2 wherein each of said ON and OFF drivers consist of a Darlington pair of transistors.

4. The motion sensor of claim 1 wherein each of said pulse generators comprises a one shot.

5. The motion sensor of claim 1 further comprising a pair of diodes coupling said ON and OFF lines, respectively, to an input of said isolating means to prevent current from either of said ON and OFF lines from flowing to the other of said ON and OFF lines.

6. The motion sensor of claim 1 wherein said isolation circuit comprises a transistor having two electrodes coupling said ON and OFF lines to said power supply and having a control electrode coupled to an output of each of said pulse generators.

7. The motion sensor of claim 6 further comprising a second transistor coupling a control electrode of said first transistor to ground, and a third transistor coupled between a control electrode of said second transistor and ground with a control electrode coupled to said outputs of each of said pulse generators.

8. In a motion sensor for detecting the presence or absence of motion and providing an activating signal, an improvement for providing ON and OFF signals on ON and OFF lines to a relay controlling power to a load, comprising:

a first pulse generator, having an input coupled to receive said activating signal, for producing a pulse output responsive to a first state of said activating signal;

a first driver consisting of a Darlington pair of transistors coupling an output of said first pulse generator to said ON line;

a second pulse generator having an input coupled to receive said activating signal for producing a pulse responsive to a second state of said activating signal;

a second driver consisting of a second Darlington pair of transistors coupling an output of said second pulse generator to said OFF line;

first and second diodes having anodes coupled to said ON and OFF lines, respectively, and cathodes coupled together;

a power supply for said motion sensor;

an isolating transistor having one electrode coupled to said cathodes of said first and second diodes, a second electrode coupled to an input of said power supply and a control electrode coupled to said outputs of said first and second pulse generators; and a capacitor coupled to said input of said power supply.

9. The motion sensor of claim 8 wherein each of said pulse generators comprises a one shot circuit, with each having an opposite input coupled to receive said activating signal, and further comprising a second isolating transistor coupling a control electrode of said first mentioned isolating transistor to ground and a third isolating transistor coupling a control electrode of said second transistor to ground and having a control electrode coupled to said outputs of said one shot circuits.

10. The motion sensor of claim 1 wherein said motion sensor further comprises:

oscillator means for generating an ultrasonic transmission frequency;

a transmission plate, coupled to said oscillator means, for emitting ultrasonic sound at said transmission frequency;

a plurality of receivers for detecting reflections of said ultrasonic sound;

a bandpass filter coupled to said receivers for passing said transmission frequency;

a low pass demodulator coupled to said bandpass filer for passing a doppler shift signal;

amplifier means, coupled to said lowpass demodulator, for amplifying said doppler shift signal;

narrow band filter means, coupled to said amplifier means, for passing a band of said doppler shift signal corresponding to human movement;

switching means, coupled to said narrow band filer means, for discharging a first node;

a resistor and capacitor coupled to said first node and to a voltage source for charging said first node to above a first voltage level in a first, predetermined time;

comparator means, having a first input coupled to said first node and a second input coupled to a voltage reference, for producing an output signal when said first input has a lower voltage than said second input; and control means, coupled to said comparator means, for supplying said activating signal.

11. An apparatus for controlling power to a load coupled between hot and neutral lines of an AC line source responsive to sensed motion or absence of motion, comprising:

a latching relay coupled between one of said hot and neutral lines and said load and having 0N and OFF inputs coupled to first and second activating coils for switching said relay ON and OFF, respectively;

a transformer having a primary winding coupled to one of said hot and neutral lines and a secondary winding coupled at one end to a DC ground line;

a rectifier coupled to a second end of said secondary winding of said transformer, an output of said rectifier being coupled to an end of said first and second relay coils opposite said ON and OFF lines; and a motion sensor including a transmitter for generating ultrasonic waves, a receiver for receiving said ultrasonic waves, a processing circuit coupled to said receiver for detecting the presence or absence of a doppler shift of said ultrasonic waves, a first pulse generator coupled between an output of said processing circuit and said ON line, and a second pulse generator coupled between said output of said processing circuit and said OFF line.

12. The apparatus of claim 11 further comprising:

a power supply for said motion sensor having an input coupled to receive power from said 0N and OFF lines;

an isolating circuit coupled between said ON and OFF lines and said power supply input for isolating said power supply from said ON and OFF lines when a pulse is generated by either of said first and second pulse generators; and a capacitor coupled to an input of said power supply.

* * * * *